United States Patent [19]

Goullin et al.

[11] 4,238,748

[45] Dec. 9, 1980

[54] MAGNETICALLY CONTROLLED SWITCH WITH WETTED CONTACT

[75] Inventors: Jean-François Goullin; Michel Nicolas, both of Courbevoie, France

[73] Assignee: Orega Circuits et Commutation, Paris, France

[21] Appl. No.: 908,851

[22] Filed: May 23, 1978

[30] Foreign Application Priority Data

May 27, 1977 [FR] France ..... 77 16338

[51] Int. Cl.[3] ..... H01H 29/00; H01H 1/08; H01H 51/22

[52] U.S. Cl. ..... 335/56; 335/58; 335/82; 335/280

[58] Field of Search ..... 335/56, 57, 58, 82, 335/280

[56] References Cited

U.S. PATENT DOCUMENTS

| | | | |
|---|---|---|---|
| 2,923,792 | 2/1960 | Fry | 335/56 X |
| 3,144,533 | 8/1964 | Donath | 335/56 |
| 3,261,942 | 7/1966 | Wessel | 335/280 X |
| 3,343,110 | 9/1967 | Grobe | 335/58 X |
| 3,529,268 | 9/1970 | Rauterberg | 335/56 |
| 3,643,185 | 2/1972 | Zimmer | 335/58 |

*Primary Examiner*—Fred L. Braun

*Attorney, Agent, or Firm*—Cushman, Darby & Cushman

[57] ABSTRACT

The invention relates to a magnetically controlled switch with contacts wetted by a conductive liquid. It is characterized in that the wettable contact surfaces of the electrodes are selectively connected to one another by a wettable ferromagnetic moving element covered with mercury which is held solely by the surface tension forces of the mercury. The absence of any polarizing force and the lightness of the moving element enable the switch to operate with a minimal energy consumption and stabilize it against accelerations. Principal application to any low-power circuit and in particular to telephone circuits.

17 Claims, 8 Drawing Figures

MAGNETICALLY CONTROLLED SWITCH WITH WETTED CONTACT

This invention relates to a magnetically controlled switch of the wet-contact type.

Switches having contacts wetted by a conductive liquid generally formed by mercury or an amalgam with mercury are known in the art. However, the majority of existing types require a free reserve of the conductive liquid and, as a result, are only able to function satisfactorily for positions of their axis which are well defined in space.

Some switch devices contain a reserve of liquid held by traps of various design which, apart from the complexity of their construction, are generally attended by the disadvantage that they accept the liquid retained by its surface tension, but restore it with greater difficulty, the more effective the trap. This disadvantage is more pronounced, the greater the volume of the switch and the greater the distance between the above-mentioned reservoir and the contacts, thus impairing the operation of the contacts.

Other switch devices do not have any liquid reserve, although the inner surface area of their envelope is very considerable by comparison with that of the electrodes and the normal consumption of the liquid, due to the contact breaking phenomena of mechanical or electrical origin, cannot be compensated by lack of any reserve, which considerably reduces their breaking capacity and their service life.

Still others are sufficiently restricted in their dimensions for all the liquid accommodated in the chamber to be fixed by the surface tension and capillarity forces on the fixed or moving electrodes which form the various parts of the contacts. In the known devices, however, the electrical connection is established either by means of magnetically driven sliding elements which, in addition to the mechanical precision required for their operation and, unless strictly observed, likely to cause jamming seriously detrimental to their reliability, have to comprise both wettable zones and non-wettable zones which are more difficult to create, the smaller these elements are in size, or by the partial displacement resulting from the deformation of a conductor formed by the liquid providing the contact, irrespective of whether this deformation is due to the combination of a magnetic field situated outside the device with the electromagnetic field created by an intense current passing through the liquid conductor or to an external cause of mechanical origin, piezoelectric origin, etc.

The use of these devices necessitates complex, onerous and bulky control circuits which, in addition, are capable of impairing the galvanic separation of the control and controlled circuits.

The device according to the present invention performs the function of a contact between at least two electrodes capable of being wetted by a conductive liquid without any free reserve of this conductive liquid and, hence, irrespective of its position in space, with or without a memory effect and having a greatly reduced internal volume which provides for filling under a high gas pressure for protecting the contacts, the connection between the moving and fixed parts of the contacts being free from any danger of non-operation, the change of state of the device being magnetically controlled which, in addition to simplicity, provides for the best separation between the various control circuits.

The design of this device is such that its production is readily compatible with assembly-line techniques.

The present invention relates to a switch which does not have any of the disadvantages referred to above and which may be used in any position. The number of ferromagnetic electrodes situated inside the cavity is virtually limited to the contact surfaces which enables a conductive liquid to be used in small quantities without any need for a large reserve. As a result, this liquid is trapped by the surface tension on the wettable surfaces. The switch is therefore unaffected by its orientation in space. The contact between the electrodes is established by a moving element of ferromagnetic material wetted with mercury for example which is held by the surface tension of the mercury on the surfaces to which it is applied and which is therefore capable of eliminating the need for any mechanical or magnetic biassing, thereby considerably reducing the energy required for manipulating the moving contacts.

According to the invention, the switch is primarily characterised in that a lightweight moving element of a ferromagnetic material wetted by said liquid at least over its contact surfaces is displaceable inside the cavity between at least two fixed electrodes of which the contact surfaces are wettable solely at their ends, the change of position of said element establishing the contacts being obtained by an external control means which creates a magnetic field passing through said cavity and the electrical contact established in the position assumed by said element is maintained, in the absence of said magnetic field, by the action of the surface tension forces, the position of the switch in space being immaterial.

In cases where the switch is provided with at most three electrodes, the moving element rests on a common electrode.

When the switch comprises several pairs of electrodes arranged oppositely in twos and capable of being selectively traversed by a magnetic field, the moving element is positioned between the magnetised contact surfaces.

Other features will become apparent from the following description of several embodiments which is given by way of non-limiting example in conjunction with the accompanying drawings, wherein.

Figure 1:
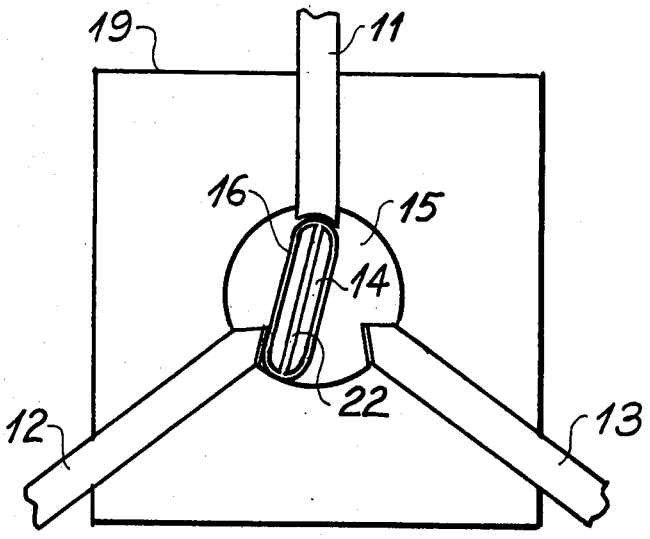
FIG. 1 is a section through a switch with three electrodes.

FIG. 1 is a section through a switch comprising three electrodes 11, 12 and 13 of ferro-magnetic material. The electrodes 11 and 12 are connected by a moving element 14. The contact surfaces of the electrodes are wettable and are covered by a layer of mercury for example. The moving element 14 is also made of a ferromagnetic material, in this case ferronickel, its entire surface being wettable and covered by a layer 16 of mercury. The mercury may of course be replaced by any other suitable conductive liquid, for example an amalgam.

Figure 7:
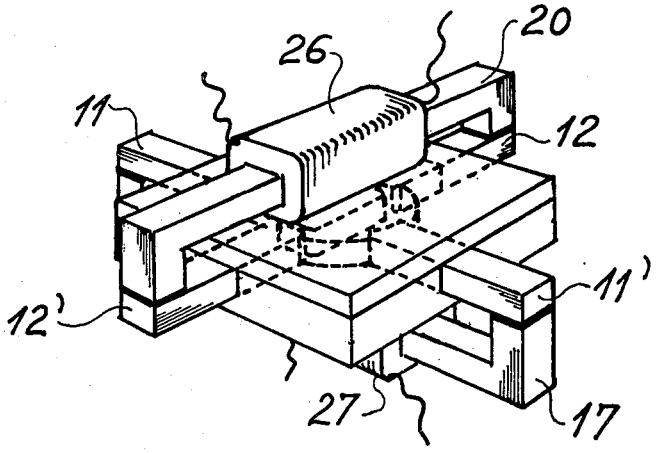
FIGS. 7 and 8 are perspective views of two examples of the magnetic control circuit.
Figure 8:
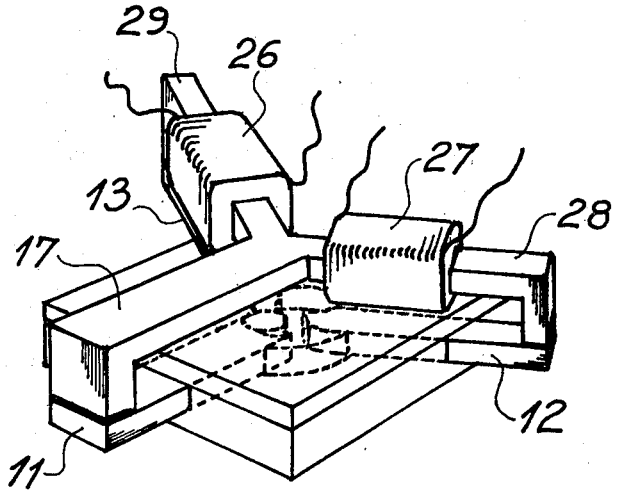

The moving element 14 changes position under the effect of magnetic field(s) applied between the electrodes 11–12 or 11–13, as will become apparent from the description of FIGS. 7 and 8.

Figure 2:
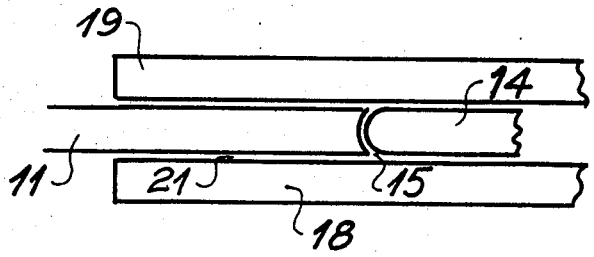
FIG. 2 is a section through part of the switch in a plane perpendicular to that of the preceding Figure.

FIG. 2 is a section through the switch in a plane perpendicular to the plane of the preceding section and passing through the electrode 11. A cavity 15 is formed between the two glass plates 18 and 19 which bear against one another either directly or indirectly through spacer members. The electrode 11 is disposed between the two plates 18 and 19 and is sealed in fluid-tight manner either directly or by means of a composition 21, for example enamel. In this case, the moving element 14 is cylindrical and terminates in a substantially spherical portion which fits into a complementary recess in the contact surface of the electrode 11.

It can be seen that the volume and, hence, the inner surface area of the cavity may indeed be reduced to the minimum. Its height is less than 1 mm and its diameter of the order of 2 to 4 mm. Since the travel of the moving element cannot exceed 5/10 mm, it is this distance and the opposite surfaces which determine the breaking function before or after the change of state. The weight of the moving element 14 is of the order of 10 milligrammes and is distinctly below the surface tension force of the mercury which enables the switch not only to be held in any position, but also to be exposed to an acceleration of the order of 50 g without either the moving element or the mercury being displaced.

As already mentioned, the low volume of the cavity provides for a reduction in the quantity of mercury. The quantity of mercury is further reduced by virtue of the fact that the moving element has a diameter which is only slightly smaller than the thickness of the cavity 15 and is covered by a layer of mercury which, when it moves, shows a surface forming a tangent with part of the inner surface of the cavity. Thus, the moving element 14 is in continuous confronting relation with the cavity walls. As a result, when this element moves, it recovers the small droplets of mercury which are produced on breakage of the contacts at the moment when the bridge of mercury spanning the wetted surfaces collapses. It is pointed out that this sweep zone is situated in the vicinity of the contact surfaces, i.e. in the region where the most droplets are formed, thus rendering this function more effective.

Accordingly, the switch consumes very little mercury. Nevertheless, in order further to increase its service life, it is advantageously provided with a small reserve of mercury. This reserve of mercury is formed on the one hand by increasing the size of the wettable conductive surfaces. To this end, either the magnetic material of the moving element 14 is porous or a longitudinal hole 22 having wettable walls is drilled through the element 14 (FIG. 1).

On the other hand, at least one of the electrodes is hollow, for example the electrode which is used as a pumping pipe for conditioning the atmosphere of the cavity and introducing the mercury. The inner volume of the pumping pipe, increased near the contact surface and suitably wetted, is used as reserve.

Figure 3:
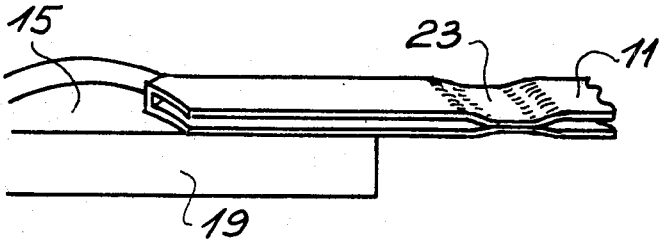
FIG. 3 is a section through a hollow common electrode.

FIG. 3 is a section on a much larger scale through the electrode 11 arranged on the plate 19 in which the cavity 15 has been formed. The plate 18 has been removed to show the detail of the electrode 11. The hollow part of this electrode was flattened at 23 during sealing after having been filled with mercury (not shown) and gas under pressure.

These reserves of mercury differ essentially from the reserves existing in the majority of conventional switches in that they are entirely held by the surface tension of the mercury which wets the surfaces and are not displaced by the accelerations, however considerable, to which they may be exposed.

The device is also distinguished by the fact that the connection between the moving element 14 and the common fixed electrode 11 is free from any mechanical adjustment, being provided by the film 16 of the conductive liquid which is integral both with the electrode 11 and with the element 14.

Figure 4:
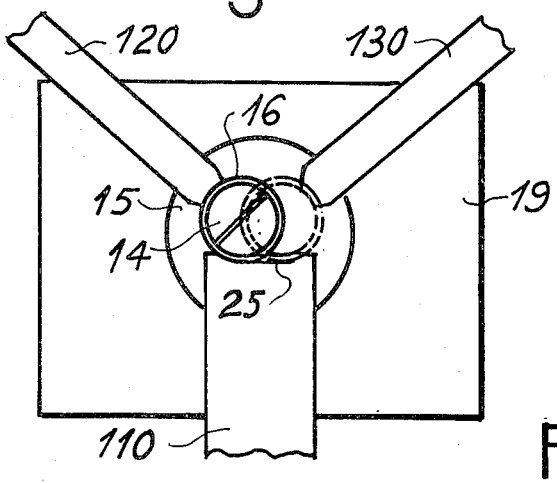
FIG. 4 is a section through a switch in which the moving element is circular in shape.

FIG. 4 shows a modified embodiment in which the contact ends of the electrodes 110, 120 and 130 are concave in shape, the moving element 14 having at least one rounded surface. The electrode 110 which provides access to the cavity 15 has one end for the contact 25 which is larger in dimensions than the electrodes 120 and 130. The element 14 is shown in another contact position denoted by chain lines.

In this case, too, it is pointed out that no particular mechanical adjustment is necessary for ensuring contact between the fixed and moving elements, contact being established simply by the liquid wetting of these surfaces. In the same way as before, the element 14 may be porous or hollow and may thus contain a trapped reserve of conductive liquid.

Figure 5:
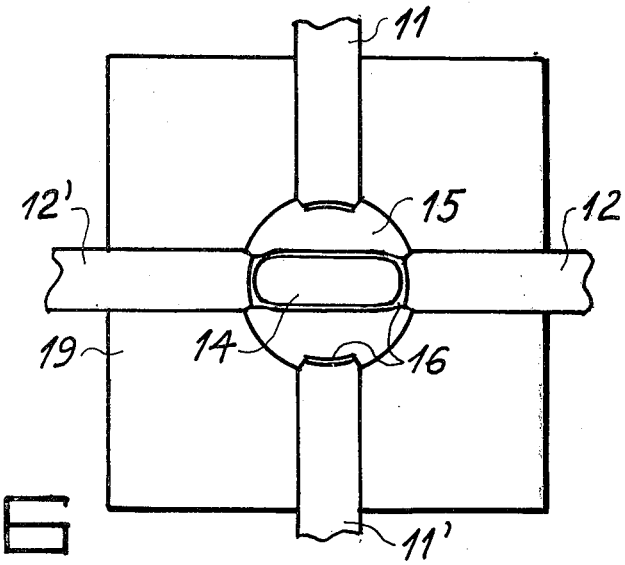
FIG. 5 is a section through a switch comprising two pairs of electrodes.

FIG. 5 shows a variant of the switch provided with two pairs of electrodes 11 and 11', 12 and 12' arranged oppositely in twos. The moving element 14 is entirely supported by the surface tension of the layers 16 of mercury.

Figure 6:
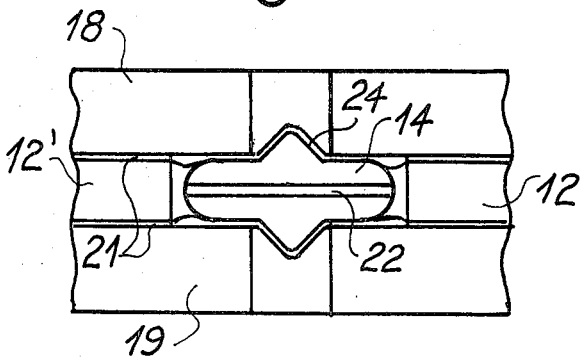
FIG. 6 is a section through part of a switch comprising several pairs of poles in which the moving element comprises pivots.

FIG. 6 is a partial section through the switch in a plane perpendicular to that of FIG. 5 and along one pair of electrodes 12, 12'. The moving element 14 comprises a pair of pivots 24 which fit into the corresponding cavities formed in the plates 18 and 19. This arrangement ensures the centring of the moving element and increases the resistance of the assembly to accelerations.

In a variant, the central parts of the plates 18 and 19, in which these cavities are formed, are conductive and used as electrodes. The pivots are wettable, as are all the surfaces of the moving element. They are covered by a layer of mercury and thus ensure good contact between the electrode and the moving element.

It can be seen that the switch according to the invention is provided with a cavity which is considerably smaller in size than the cavity of conventional switches by virtue of the fact that this cavity has just the dimensions to enable the moving element to pass from one contact surface to another, only the ends of the fixed electrodes carrying the contact surfaces being situated inside the cavity. This is possible because the contacts are supported entirely by the surface tension forces of the mercury with the result that the electrode do not have to be displaced inside the cavity.

The main effect of these extremely reduced dimensions of the cavity and the moving element is immediately to recycle the mercury released during the preceding switching operations and, hence, to reduce the consumption of mercury, thereby considerably increasing the service life of the switch and enabling it to withstand considerable accelerations in any direction whilst, at the same time, requiring only minimal operational energy.

As mentioned above, the various switch devices described are magnetically controlled, the necessary fluxes being generated by permanent or semi-permanent magnets or coils or by a combination of these magnetic field generators which will preferably be associated with magnetic circuits made of electrically conductive or insulating materials.

By way of example, FIG. 7 illustrates one method of controlling the switch shown in FIG. 5. A first magnetic circuit in the form of a coil 27 associated with the magnetic circuit 17 is magnetically coupled with the electrodes 11 and 11'. A second similar circuit consisting of a coil 26 and a flux conductor 20 is associated with the electrodes 12 and 12'.

The moving element 14 shown in FIG. 5 will be positioned in such a way that it recloses the magnetic field of the circuit associated with that of the coils 27 or 26 which is subjected to electrical excitation.

It is pointed out that the efficiency of the device is increased even further if the magnetic circuits referred to above comprise few, if any, air gaps. However, the electrical insulation between the electrodes 11, 11' and 12, 12' must be maintained. Accordingly, the flux conductors 17 and 20 are with advantage made of completely or partly insulating materials, such as soft ferrites of very high resistivity.

Similarly, and still by way of example, the switches shown in FIGS. 1 and 4 may be actuated, as shown in FIG. 8, from the flux generated by one of the coils 27 or 26 associated with the flux conductor 28 or 29 which is itself magnetically coupled with the electrodes 11, 12, 13 in FIG. 1 or 110, 120, 130 in FIG. 4. Once again, the flux conductors 29 and 28 will consist completely or in part of an electrically insulating material, as described above.

In the examples which have just been described, a single electrical pulse of sufficient amplitude and duration (as short as 2 to 5 milliseconds) is sufficient to bring the switch into operation, the moving element retaining its new position by virtue, as mentioned above, of the surface tension and capillarity forces through which it is associated with the fixed electrodes.

In another embodiment, a device similar for example to that shown in FIG. 1 will have one of the electrodes 12 or 13 non-wettable by the mercury.

By replacing one of the coils and all or part of the corresponding flux conductor by a permanent magnet, the device is provided with a systematically defined rest position. Accordingly, for a permanent, suitably polarised excitation of sufficient amplitude, the moving element will leave this rest position to establish the working contact of the switch. In cases where it is only this working contact which is necessary and in order to reduce the energy required for the change of state from the rest position, this latter electrode cannot be wetted by the mercury, thus eliminating the need for the magnetic field controlling the work to have to overcome the capillarity forces which would occur if both the rest electrode and the moving element were to be wettable.

The magnetic mass of the magnet is normally adjusted in such a way that, in the absence of excitation in the coil, the flux of said magnet re-attracts the moving part of the switch towards its rest position.

What is claimed is:

1. A magnetically controlled switch with wetted contacts, comprising:

a housing defining a closeable cavity having a non-wettable inner surface;

at least two fixed electrodes of ferromagnetic material having their contact surface inside said closeable cavity and wettable only at their ends;

a conductive liquid intended to establish electrical contact between at least two of said at least two fixed electrodes disposed in said cavity;

a lightweight moving element of ferromagnetic material wetted by said liquid at least over its contact surfaces, displaceable in a plane inside said cavity between said at least two fixed electrodes in continuous confronting relation to said non-wettable inner surface; and external control means, which creates a magnetic field passing through said cavity, for changing the position of said element making said electrical contact, whereby the electrical contact established in the position acquired by said element is retained, in the absence of said magnetic field, by the action of surface tension forces, the position in space of the switch being immaterial, said cavity surface having such dimensions as to prevent movement of said element perpendicular to said plane.

2. A switch as claimed in claim 1, characterized in that said cavity comprises a stack of non-wettable insulating plates sealingly assembled in vacuo and under pressure, said electrodes being locally wettable and one of them being hollow and closeable for filling with a gas under pressure and for introduction of said conductive liquid for the contacts which is held in reserve in a small quantity, the cavity being of such dimensions that it only allows the moving element to be displaced in the plane containing its displacement and the sweeping of most of the surface of said cavity with each change in position of this element.

3. A switch as claimed in claim 2 wherein said moving element has rounded ends and pivots, with interposition of a film of said liquid, about an axis perpendicular to the plane of rotation, said at least two fixed electrodes including at least two pairs of fixed electrodes.

4. A switch as claimed in claim 2 or claim 1, wherein said moving element has one rounded end, an amount of the liquid conductor being disposed at said one rounded end, said one rounded end remaining in contact through said amount of the liquid conductor with one of said at least two fixed electrodes, said one of said fixed electrodes acting as a pivot for pivoting said moving element about a fixed axis of rotation located at said one rounded end, said one of said at least two fixed electrodes serving as a conductor to at least one electrical circuit.

5. A switch as claimed in claim 1, characterised in that the relative position of the fixed electrodes inside the cavity and the distance travelled by the moving element are the factors determining the contact-breaking function, so that their choice determines the useful energy of the control means.

6. A switch as claimed in claim 1, characterised in that said external control means is arranged outside the cavity on a magnetic circuit connecting two co-operating electrodes.

7. A switch as claimed in claim 6, characterised in that the magnetic circuits comprise a substance conducting the magnetic flux in an insulating material and, as a result, connect said electrodes without any disadvantages.

8. A switch as claimed in claim 6, characterised in that at least one of the magnetic circuits ensuring a preferential, stable rest position is formed by a magnet.

9. A switch as claimed in claim 1 or claim 3, characterised in that said conductive liquid is mercury partially stored in at least one of the group consisting of the moving element and the at least two fixed electrodes of the switch.

10. A switch as claimed in claim 1, characterised in that said cavity has a necessary minimum volume and a height which substantially corresponds to the thickness of the moving element contained in said cavity, said moving element being held by the surface tension of the liquid conductor on the co-operating electrodes(s) to which it has been applied.

11. A switch as claimed in claim 1, comprising only two fixed electrodes.

12. A switch as claimed in claim 1, wherein said at least two fixed electrodes include two pair of fixed electrodes, arranged oppositely in twos.

13. A switch as claimed in claim 12, characterised in that the moving element has rounded ends and pivots, with interposition of a film of said liquid, about an axis perpendicular to the plane of rotation.

14. A switch as claimed in claim 3 or claim 6, charasterised in that said conductive liquid is mercury partially stored in at least one of the group consisting of the moving element and the at least two fixed electrodes of the switch.

15. A switch as claimed in claim 1 wherein said moving element has an axis of rotation located at one of said at least two fixed electrodes, said moving element having at least one pivotal end having a rounded cross section formed in a plane perpendicular to said axis of rotation, an amount of said liquid conductor being disposed at said pivotal end, said pivotal end remaining in contact with said one of said at least two fixed electrodes, said one of said at least two fixed electrodes serving as a pivot for pivoting said moving element about said axis of rotation, said one of said at least two electrodes serving as a conductor to at least one electrical circuit.

16. A switch as claimed in claim 1 wherein said moving element defines a bore having a wettable surface extending between said contact surfaces for storing said conductive liquid and transferring said conductive liquid between said contact surfaces.

17. A switch as claimed in claim 1 wherein said cavity has opposing plane surfaces, said moving element having opposite plane faces disposed in confronting relation with said cavity plane surfaces.

* * * * *